US010038263B1

(12) United States Patent
Kubota et al.

(10) Patent No.: US 10,038,263 B1
(45) Date of Patent: Jul. 31, 2018

(54) CONNECTOR WITH A SLIDER FOR PREVENTING AN ADVERSE EFFECT DUE TO THE EXTRA LENGTH OF A FLAT CABLE

(71) Applicant: LENOVO (SINGAPORE) PTE. LTD., Singapore (SG)

(72) Inventors: Shinichi Kubota, Yokohama (JP); Satoshi Douzono, Yokohama (JP); Takehito Yamauchi, Yokohama (JP)

(73) Assignee: LENOVO (SINGAPORE) PTE. LTD., Singapore (SG)

( * ) Notice: Subject to any disclaimer, the term of this patent is extended or adjusted under 35 U.S.C. 154(b) by 0 days.

(21) Appl. No.: 15/697,841

(22) Filed: Sep. 7, 2017

(30) Foreign Application Priority Data

Jul. 19, 2017 (JP) ..... 2017-139743

(51) Int. Cl.

| | |
|---|---|
| ***H01R 13/15*** | (2006.01) |
| ***H01R 13/62*** | (2006.01) |
| ***H01R 12/89*** | (2011.01) |
| ***H01R 12/79*** | (2011.01) |
| ***H01R 12/91*** | (2011.01) |
| ***H01R 12/70*** | (2011.01) |
| ***H01R 12/88*** | (2011.01) |
| ***H01R 13/41*** | (2006.01) |
| ***H01R 12/59*** | (2011.01) |
| *H01R 13/58* | (2006.01) |
| *H01R 12/77* | (2011.01) |
| *H01R 12/72* | (2011.01) |

(52) U.S. Cl.

CPC ..... *H01R 12/89* (2013.01); *H01R 12/592* (2013.01); *H01R 12/7094* (2013.01); *H01R 12/79* (2013.01); *H01R 12/88* (2013.01); *H01R 12/91* (2013.01); *H01R 13/41* (2013.01); *H01R 12/721* (2013.01); *H01R 12/777* (2013.01); *H01R 13/58* (2013.01); *H01R 23/661* (2013.01)

(58) Field of Classification Search

CPC ..... H01R 12/79; H01R 12/87; H01R 12/88
USPC ..... 439/260, 261, 495
See application file for complete search history.

(56) References Cited

U.S. PATENT DOCUMENTS

| | | | | |
|---|---|---|---|---|
| 6,089,905 A * | 7/2000 | Shimmyo | H01R 12/79 | 439/260 |
| 6,551,128 B2 * | 4/2003 | Asai | H01R 23/667 | 439/260 |
| 6,893,278 B2 * | 5/2005 | Ohsawa | H01R 12/79 | 439/260 |
| 7,094,093 B2 * | 8/2006 | Nakano | H01R 12/771 | 439/495 |
| 7,540,764 B2 * | 6/2009 | Suzuki | H01R 12/79 | 439/260 |

FOREIGN PATENT DOCUMENTS

JP 2017068736 A 4/2017

* cited by examiner

*Primary Examiner* — Hae Moon Hyeon
(74) *Attorney, Agent, or Firm* — Shimokaji IP

(57) ABSTRACT

A connector is capable of preventing an adverse effect due to the extra length of a flat cable. The connector includes: a main body to which a terminal of the flat cable having notches formed on both sides can be connected; a slider having engaging portions engageable with the notches, respectively, and configured to reciprocate relative to the main body along an insertion direction of the flat cable; and an actuator which sandwiches and fixes the flat cable in cooperation with the main body.

2 Claims, 6 Drawing Sheets

CONNECTOR WITH A SLIDER FOR PREVENTING AN ADVERSE EFFECT DUE TO THE EXTRA LENGTH OF A FLAT CABLE

FIELD OF THE INVENTION

The present invention relates to a connector and an electronic device provided with the same.

BACKGROUND OF THE INVENTION

FPC (Flexible Printed Circuit) connectors are often used for electrical connections of an internal board in a portable electronic device such as a laptop personal computer (laptop PC), a tablet personal computer (tablet PC), or a smartphone (see Patent Document 1).

Among the FPC connectors, there is a ZIF (Zero Insertion Force) type that closes an actuator to sandwich and fix a flat cable (e.g., FFC: Flexible Flat Cable).

[Patent Document 1] Japanese Patent Application Laid-Open No. 2017-68736

SUMMARY OF THE INVENTION

The ZIF type FPC connector does not require a great force at the time of connection, and this can prevent some pins from dropping out or being bent. However, since the flat cable can be fixed by closing the actuator, the flat cable will apparently be fixed even if the connection is imperfect.

The flat cable is generally designed to have a longer length in view of ease of assembly, and an extra length is often caused by manufacturing errors. Therefore, the flat cable may be connected in a state of being flexed to protrude in the thickness direction (a so-called tilted state) due to the extra length of the flat cable. When the internal space of a product is made small, such as that of a tablet or a smartphone, a tilt given to the flat cable could cause the flat cable to interfere with liquid crystal or any other component and hence to create an adverse effect such as a display defect.

The present invention has been made in view of the above circumstances, and it is an object thereof to provide a connector capable of preventing an adverse effect due to the extra length of a flat cable, and an electronic device provided with the same.

In order to solve the above problems, the connector of the present invention and the electronic device provided with the same adopt the following aspects.

A connector according to the first aspect of the present invention includes: a main body to which a terminal of a flat cable having notches formed on both sides can be connected; a slider having engaging portions engageable with the notches, respectively, and configured to reciprocate relative to the main body along an insertion direction of the flat cable; and an actuator which sandwiches and fixes the flat cable in cooperation with the main body.

It is also preferred that the connector should be configured such that the slider includes a central section extending in a direction perpendicular to the insertion direction, the engaging portions are provided at both ends of the central section, respectively, and a guide groove, into which each of the engaging portions is inserted and in which the engaging portion is movable along the insertion direction, is provided in the main body.

An electronic device according to the second aspect of the present invention includes the connector according to any one of the above preferred forms.

In the above-described aspects of the present invention, the flat cable is fixed to the main body at a position corresponding to the length of the flat cable by the slider reciprocating along the insertion direction, and this can deal with the extra length of the flat cable and hence a tilt given to the flat cable can be prevented.

DETAILED DESCRIPTION OF THE INVENTION

One embodiment of a connector and an electronic device provided with the connector of the present invention will be described below with reference to the accompanying drawings.

As the electronic device, for example, there is a laptop personal computer (laptop PC), a tablet personal computer (tablet PC), a smartphone, or the like.

Figure 1:
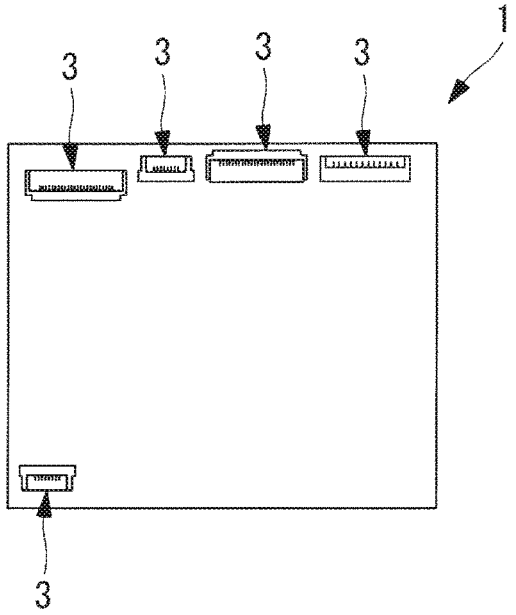
FIG. 1 is a plan view illustrating a board on which connectors according to one embodiment of the present invention are arranged.

FIG. 1 illustrates an example of a board 1 incorporated in the electronic device. On the board 1, plural connectors 3 are provided for input/output of electrical signals. As connectors 3, ZIF (Zero Insertion Force) type FPC (Flexible Printed Circuit) connectors are used. Though not illustrated, various electronic components such as a processor and a memory can be mounted on the board 1.

Figure 2:
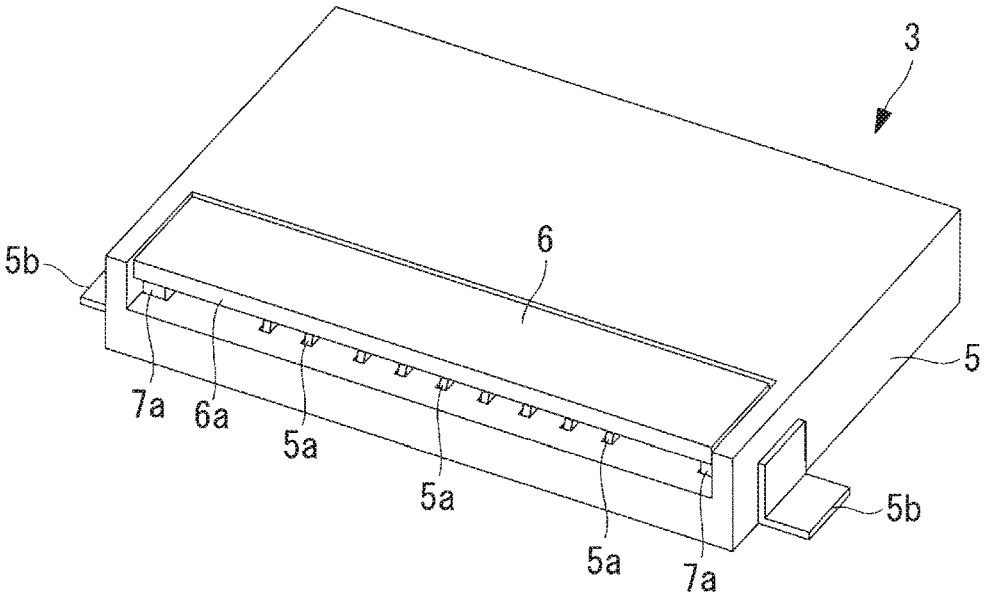
FIG. 2 is a perspective view illustrating a connector according to one embodiment of the present invention.

As illustrated in FIG. 2, each connector 3 includes a main body 5 and an actuator 6.

The main body 5 is formed into an approximately wide rectangular shape in plan view. The main body 5 has many terminal pins 5*a* to connect a flat cable 8 (see FIG. 5A) electrically to pattern wiring on the side of the board 1. Metal legs 5*b* are fixed on both sides of the main body 5, respectively. Using these legs 5*b*, the main body 5 is soldered to the board 1.

The actuator 6 is arranged to cover a recessed section formed on the front upper side of the main body 5. The actuator 6 is formed into an approximately wide rectangular shape in plan view. The actuator 6 is connected to the main body 5 to be turnable relative to the main body 5 to sandwich the flat cable 8 (see FIG. 5A) in cooperation with the main body 5, and retain the flat cable 8 in a connecting position. Specifically, the actuator 6 is turned around a turning shaft, not illustrated, between a standing position, in which a front section 6*a* of the actuator 6 stands against the main body 5, and a lying position of being laid from this standing position as illustrated in FIG. 2. Note that a worker moves the actuator 6 to each position.

Figure 3:
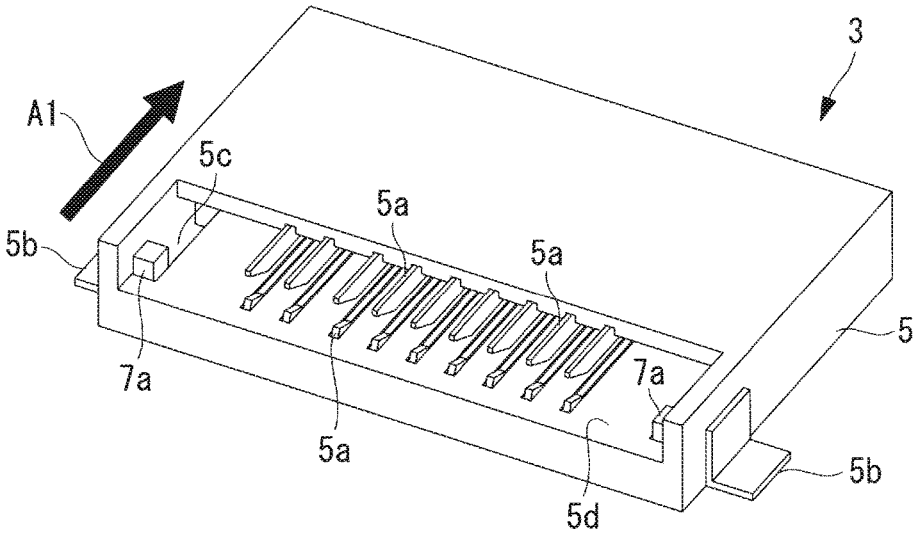
FIG. 3 is a perspective view illustrating the connector in FIG. 1, where an actuator is removed.

For ease of explanation, FIG. 3 illustrates a state in which the actuator 6 is removed. As illustrated in FIG. 3, guide grooves 5*c* are formed on both front sides of the main body 5 along an insertion direction A1 as the depth direction of the main body 5, respectively. Engaging portions 7*a* are inserted into these guide grooves 5*c* from below. Each of the engaging portions 7*a* is formed into a shape to project upward in FIG. 3, having a width corresponding to the width of each of the guide grooves 5*c*.

Figure 4:
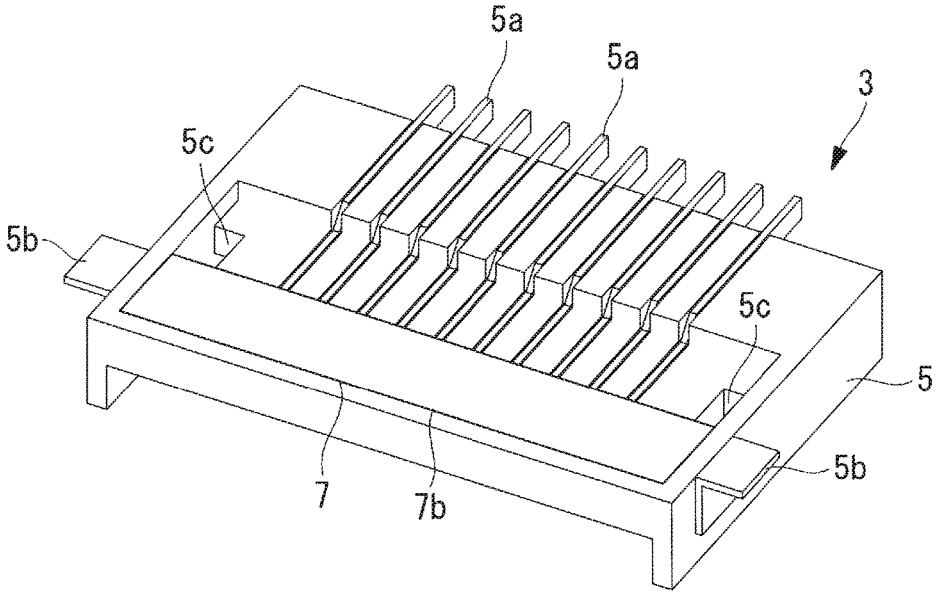
FIG. 4 is a perspective view of the connector in FIG. 1 as viewed from the backside.

The engaging portions 7*a* are provided on both sides of a slider 7 as illustrated in FIG. 4 when the connector 3 is viewed from the backside. The slider 7 is configured to include, in an integrated fashion, a plate-like central section 7*b* extending in the width direction of the main body 5, and the engaging portions 7*a* to project upward from both ends of this central section 7*b* in FIG. 3. As illustrated in FIG. 3, each of the engaging portions 7*a* has a height to project upward from a mounting surface 5*d* of the front recessed section of the main body 5. The flat cable 8 (see FIG. 5A) is mounted on this mounting surface 5*d*.

The engaging portions 7*a* are reciprocable in the insertion direction A1 along the guide grooves 5*c*. At this time, the engaging portions 7*a* are fitted in the guide grooves 5*c* with predetermined dimensional accuracy. Specifically, each face of each of the engaging portions 7*a* along the insertion direction A1 and each face of each of the guide grooves 5*c* facing the face of the engaging portion 7*a* slide along each other with a small clearance without a big backlash. Therefore, the two engaging portions 7*a* are moved synchronously in parallel with each other along the insertion direction A1.

Next, operation to connect the flat cable 8 to the connector 3 will be described.

In FIGS. 5A to 5D, a connection when the flat cable 8 is relatively short is described, while in FIGS. 6A to 6D, a connection when the flat cable 8 is relatively long is described.

Figure 5A:
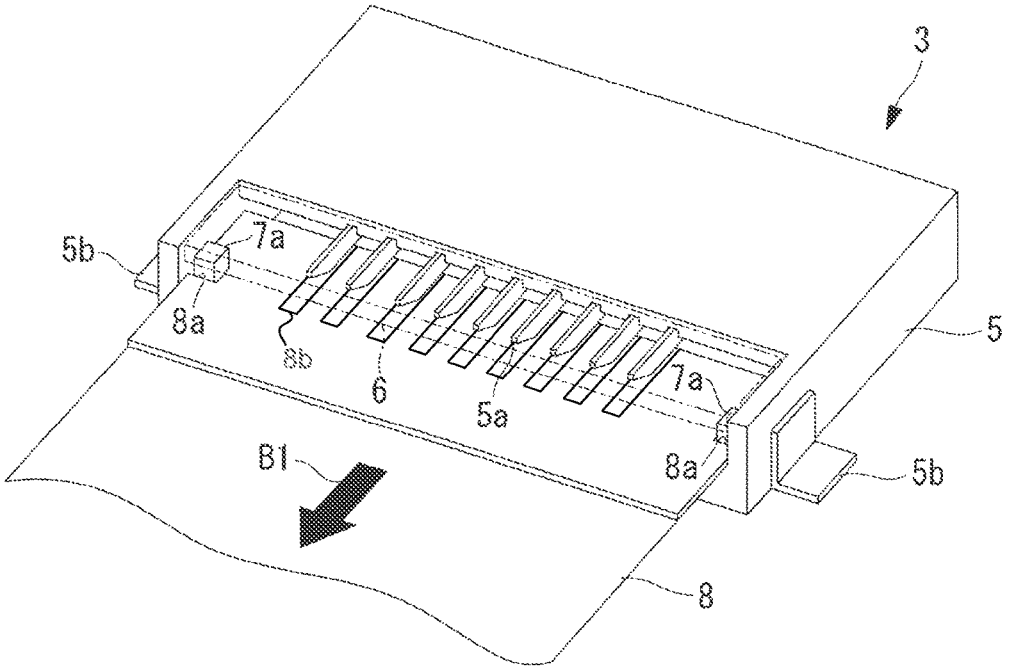
FIG. 5A is a perspective view illustrating a connector to which a relatively short flat cable is connected.
Figure 5B:
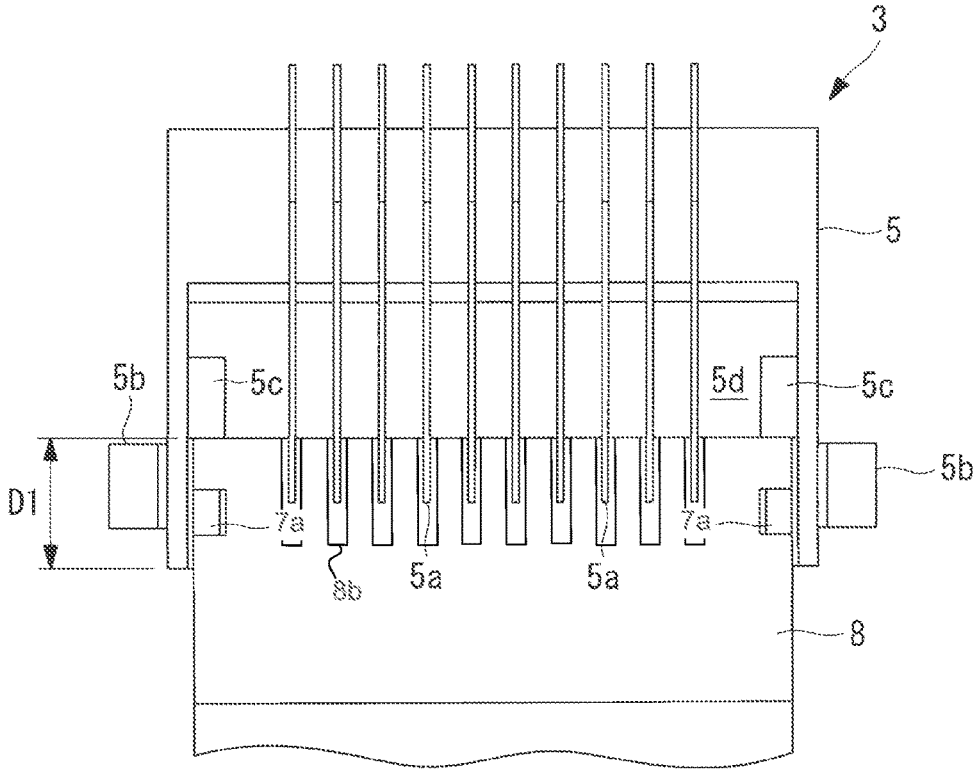
FIG. 5B is a bottom view of the connector in FIG. 5A.

As illustrated in FIG. 5A, when the flat cable 8 is relatively short, the flat cable 8 is connected at a position on the front side of the main body 5 (the side in the direction of arrow B1). For example, as illustrated in FIG. 5B, the distal portion of the flat cable 8 is overlapped with the mounting surface 5*d* of the main body 5 over distance D1 from the front of the main body 5. In this state, each terminal pin 5*a* of the main body 5 is connected to each terminal 8*b* of the flat cable 8.

For example, the flat cable 8 is an FFC (Flexible Flat Cable), and rectangular notches 8*a* are formed on both sides thereof as illustrated in FIG. 5A. The shape of each notch 8*a* corresponds to the shape of the engaging portion 7*a*.

Figure 5C:
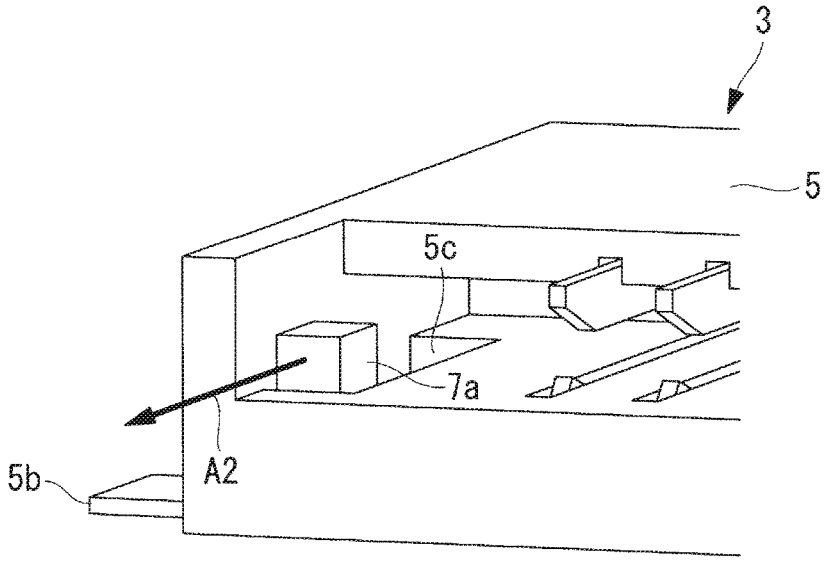
FIG. 5C is a partially enlarged perspective view illustrating the position of an engaging portion of the connector in FIG. 5A.
Figure 5D:
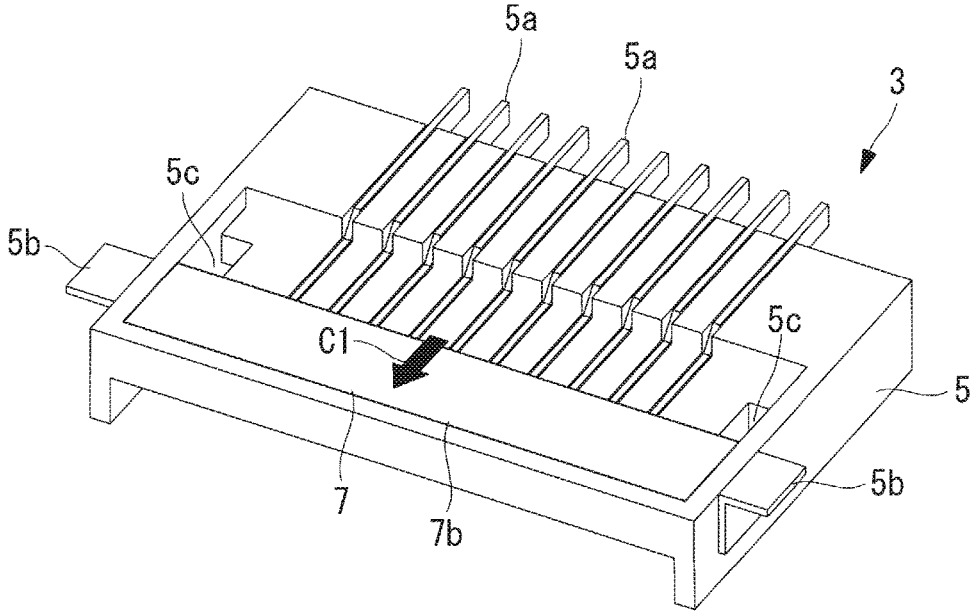
FIG. 5D is a perspective view of the connector in FIG. 5A as viewed from the backside.

As illustrated in FIG. 5C, since the flat cable 8 is relatively short, the engaging portion 7*a* advances in the near-side direction (direction of arrow A2). In the state of being engaged with the notch 8*a* of the flat cable 8, the engaging portion 7*a* slides along the guide groove 5*c* to a position corresponding to the length of the flat cable 8. At this time, the slider 7 moves in the direction of arrow C1 to a front position of the main body 5 as illustrated in FIG. 5D. After the position of the slider 7 reaches the position corresponding to the length of the flat cable 8, the actuator 6 is brought down and put into a lying state as illustrated in FIG. 2 to fix the flat cable 8 to the connector 3.

Figure 6A:
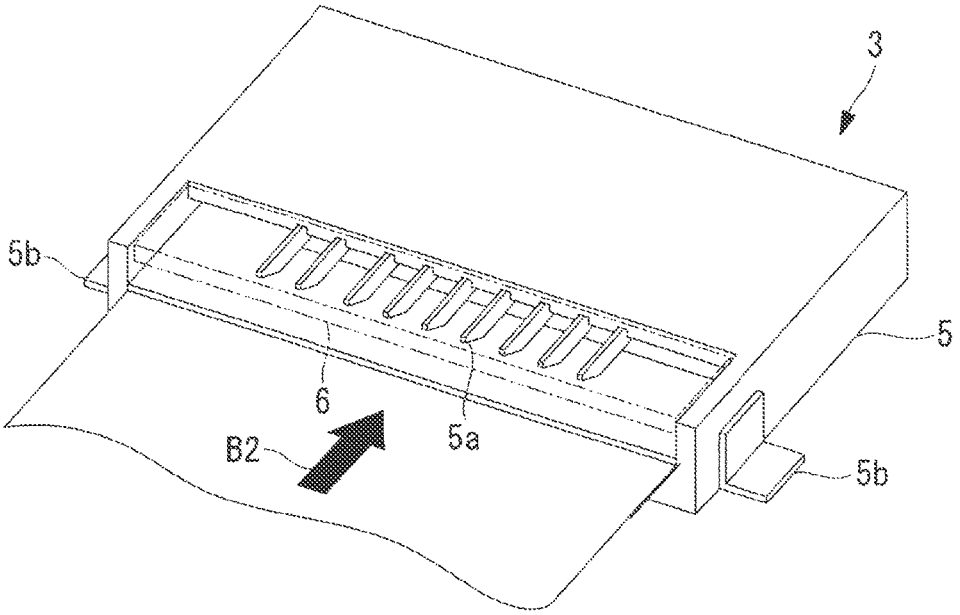
FIG. 6A is a perspective view illustrating a connector to which a relatively long flat cable is connected.
Figure 6B:
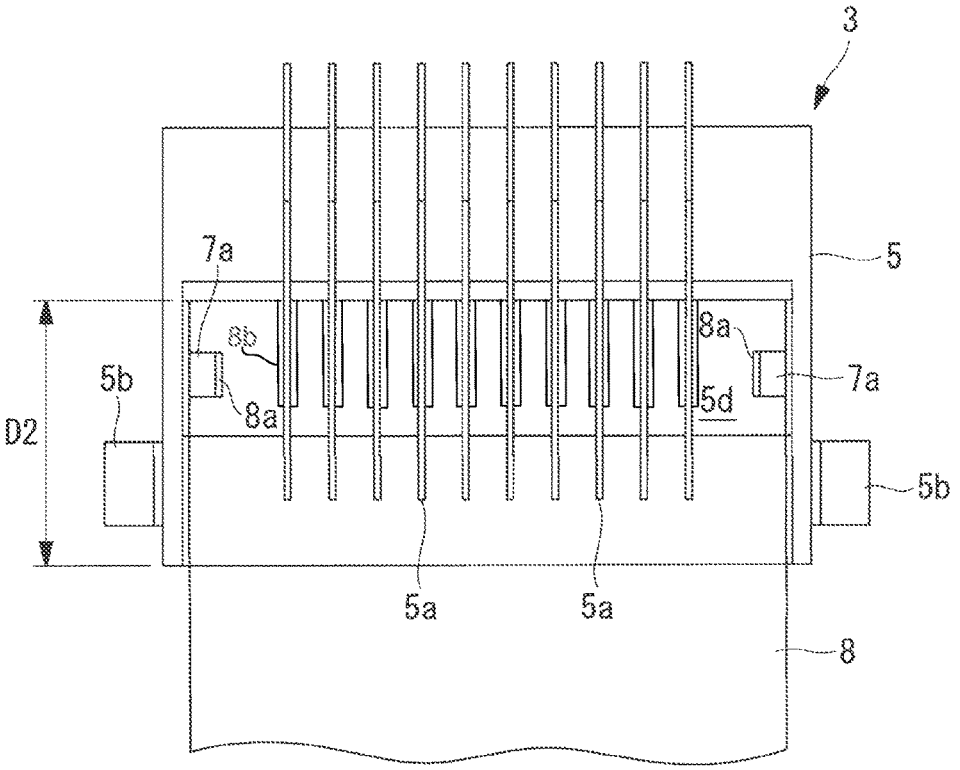
FIG. 6B is a bottom view of the connector in FIG. 6A.

As illustrated in FIG. 6A, when the flat cable 8 is relatively long, the flat cable 8 is connected at a position on the rear side of the main body 5 (the side in the direction of arrow B2). For example, as illustrated in FIG. 6B, the distal portion of the flat cable 8 is overlapped with the mounting surface 5*d* of the main body 5 over distance D2 from the front of the main body 5. At this time, the distance D2 becomes longer than the distance D1 illustrated in FIG. 5B (i.e., D2>D1). In this state, each terminal pin 5*a* of the main body 5 is connected to each terminal 8*b* of the flat cable 8.

Figure 6C:
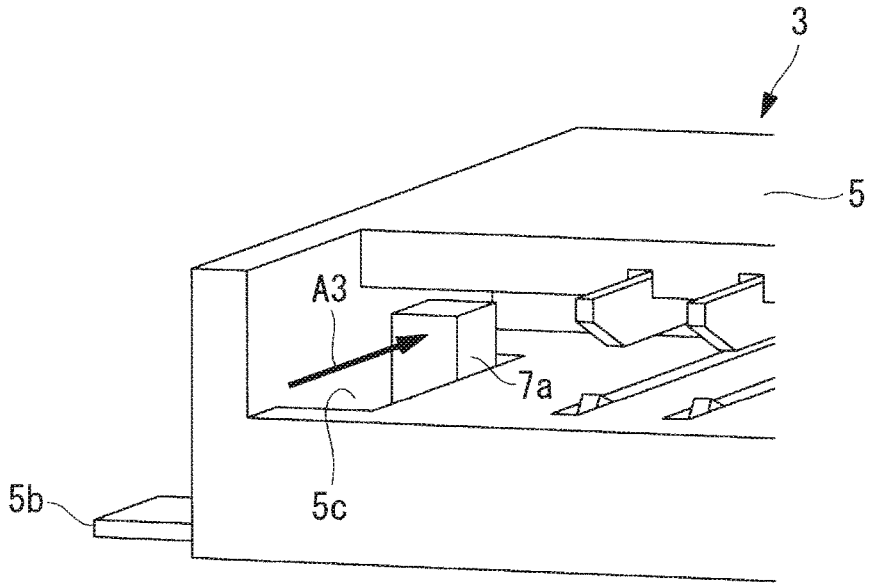
FIG. 6C is a partially enlarged perspective view illustrating the position of an engaging portion of the connector in FIG. 6A.
Figure 6D:
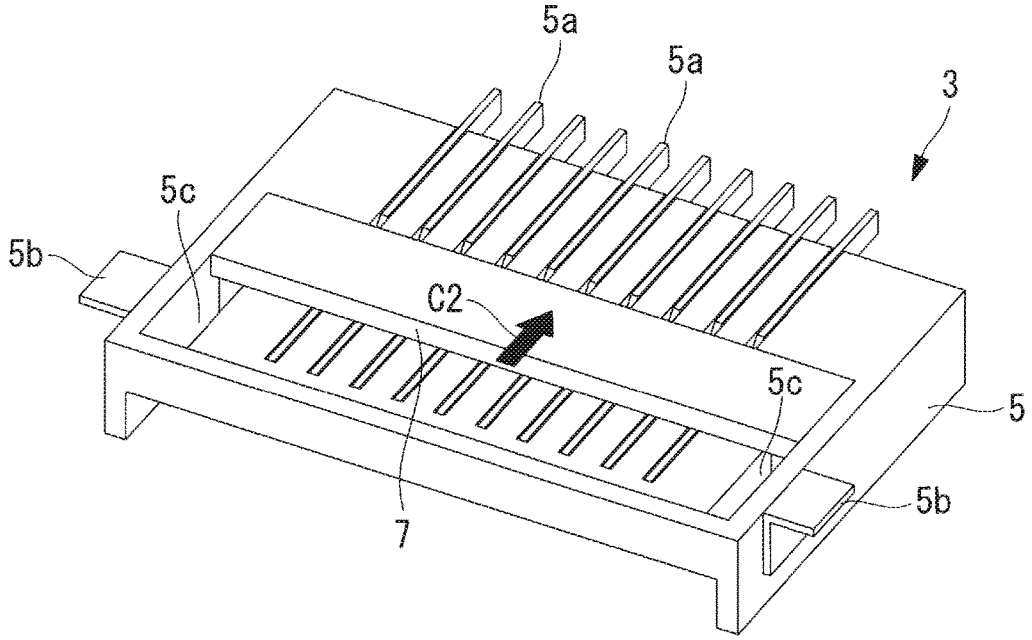
FIG. 6D is a perspective view of the connector in FIG. 6A as viewed from the backside.

As illustrated in FIG. 6C, since the flat cable 8 is relatively long, the engaging portion 7*a* retracts in the depth direction (direction of arrow A3). In the state of being engaged with the notch 8*a* of the flat cable 8, the engaging portion 7*a* slides along the guide groove 5*c* to a position corresponding to the length of the flat cable 8. At this time, the slider 7 moves in the direction of arrow C2 to a rear position of the main body 5 as illustrated in FIG. 6D. After the position of the slider 7 reaches the position corresponding to the length of the flat cable 8, the actuator 6 is brought down and put into the lying state as illustrated in FIG. 2 to fix the flat cable 8 to the connector 3.

As described above, according to the embodiment, the following operational effects can be obtained.

The engaging portions 7*a* provided on the slider 7 are inserted into the notches 8*a* formed on both sides of the flat cable 8 to guide the flat cable 8 along the insertion direction A1. Since the slider 7 reciprocates relative to the main body 5 along the insertion direction A1, the slider 7 stops at a predetermined position in the insertion direction A1 according to the length of the flat cable 8. At this stop position, the actuator 6 fixes the flat cable in cooperation with the main body 5 to ensure an electrically connected state. Thus, the flat cable 8 can be fixed to the main body 5 at a position corresponding to the length of the flat cable 8 by the slider 7 reciprocating along the insertion direction A1, and this can deal with the extra length of the flat cable 8 and hence a tilt given to the flat cable 8 can be prevented.

Since the engaging portions 7*a* are provided at both ends of the central section 7*b* of the slider 7, respectively, the engaging portions 7*a* provided respectively at both ends can be slid at the same time. Then, the guide grooves 5*c* formed along the insertion direction A1 are provided in the main body 5, and respective engaging portions 7*a* are inserted in the guide grooves 5*c*, respectively. This enables the respective engaging portions 7*a* to reciprocate accurately along the insertion direction A1 at the same time. Thus, the flat cable 8 can be positioned accurately.

The two engaging portions 7*a* are fitted into the guide grooves 5*c* with predetermined dimensional accuracy and slid. Specifically, each face of each of the engaging portions 7*a* along the insertion direction A1 and each face of each of the guide grooves 5*c* facing the face of the engaging portion 7*a* slide along each other with a small clearance without a big backlash. Therefore, since the two engaging portions 7*a* can be moved synchronously in parallel with each other along the insertion direction A1, there is no possibility that the flat cable 8 may be fixed at a tilt to the main body 5. This can prevent a connection failure between terminals.

We claim:

1. A connector, comprising:

a main body having a terminal and to which a terminal of a flat cable having notches on both sides is electrically connectable;

a slider, having engaging portions engageable with the notches respectively, and configured to reciprocate relative to the main body along an insertion direction of the flat cable; and an actuator which sandwiches and fixes the flat cable in cooperation with the main body;

wherein the slider includes at least a central section extending in a direction perpendicular to the insertion direction, wherein the engaging portions are at both ends of the central section respectively, and a guide groove, into which each of the engaging portions is inserted, and wherein the engaging portion is movable along the insertion direction, and the guide groove is in the main body.

2. An electronic device, comprising:

a connector having:

a main body having a terminal and to which a terminal of a flat cable having notches on both sides is electrically connectable;

a slider, having engaging portions engageable with the notches respectively, and configured to reciprocate relative to the main body along an insertion direction of the flat cable; and an actuator which sandwiches and fixes the flat cable in cooperation with the main body;

wherein the slider includes at least a central section extending in a direction perpendicular to the insertion direction, wherein the engaging portions are at both ends of the central section respectively, and a guide groove, into which each of the engaging portions is inserted, and wherein the engaging portion is movable along the insertion direction, and the guide groove is in the main body.

* * * * *